United States Patent [19]

Weiss

[11] Patent Number: 4,574,860

[45] Date of Patent: Mar. 11, 1986

[54] ADJUSTABLE STORM GARAGE DOOR

[76] Inventor: Otto Weiss, 22 Hunter St., Highland Mills, N.Y. 10930

[21] Appl. No.: 615,593

[22] Filed: May 31, 1984

[51] Int. Cl.[4] ..... E06B 3/48

[52] U.S. Cl. ..... 160/118; 160/206; 160/213; 160/40

[58] Field of Search ..... 160/118, 113, 117, 182, 160/206, 213, 215; 49/381, 399

[56] References Cited

U.S. PATENT DOCUMENTS

| | | | |
|---|---|---|---|
| 1,923,604 | 8/1933 | Woodruff | 160/213 |
| 2,626,433 | 1/1953 | Murch | 49/399 |
| 2,842,795 | 7/1958 | Majeske | 160/118 X |
| 2,893,070 | 7/1959 | Gauthier | 49/399 |
| 3,263,734 | 8/1966 | Lister | 160/113 |
| 3,374,821 | 3/1968 | White | 160/206 X |
| 3,380,506 | 4/1968 | Good et al. | 160/206 X |
| 3,390,418 | 7/1968 | Sheridan | 160/206 X |
| 3,410,330 | 11/1968 | Matyas | 160/206 |
| 3,448,786 | 6/1969 | Edgerton | 160/206 X |
| 3,906,670 | 9/1975 | Burton | 49/381 |
| 4,064,590 | 12/1977 | Smith | 160/118 X |

*Primary Examiner*—Ramon S. Britts
*Assistant Examiner*—David M. Purol
*Attorney, Agent, or Firm*—Leo C. Krazinski

[57] ABSTRACT

An adjustable storm garage door having a pair of foldable doors open at the center with each pair adjustably mounted to a jamb of the garage in spaced relationship with an existing overhead garage door for providing an insulating space between the doors.

6 Claims, 17 Drawing Figures

Fig. 1.
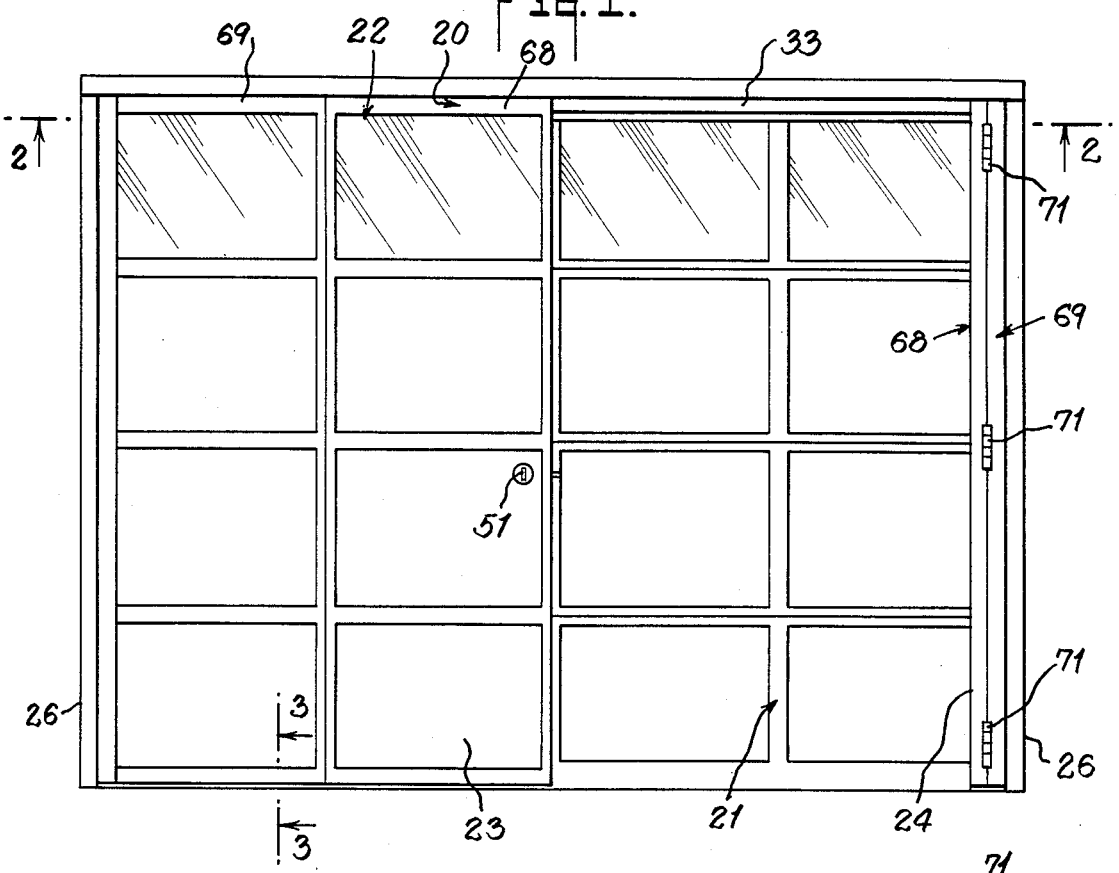
Fig. 2.
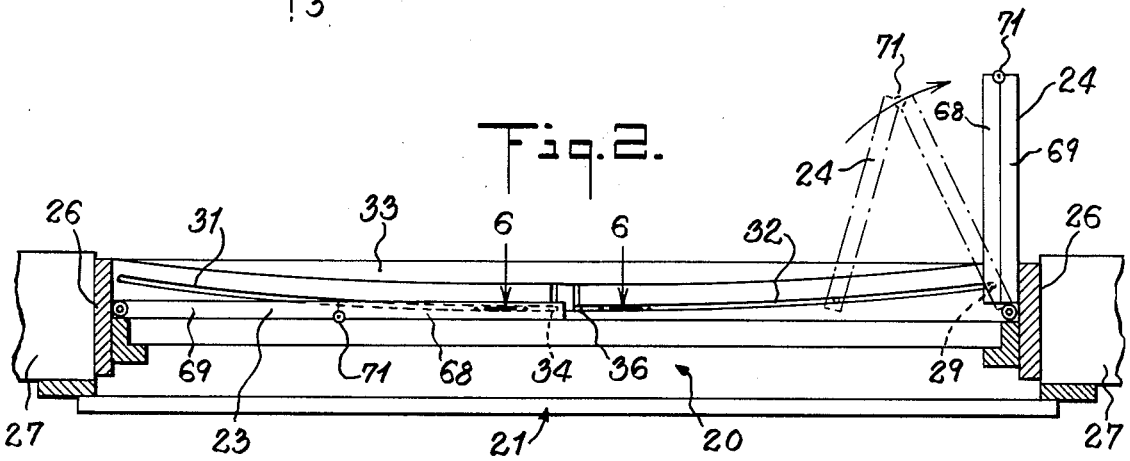
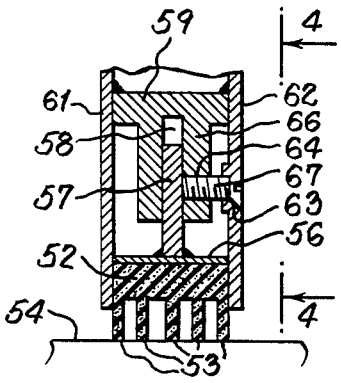
Fig. 3.
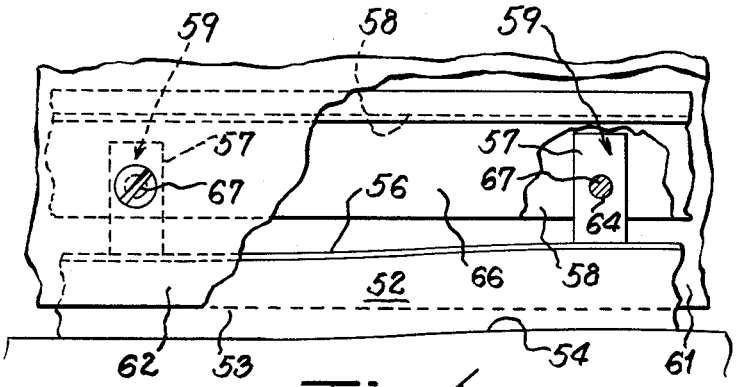
Fig. 4.

Fig. 5.
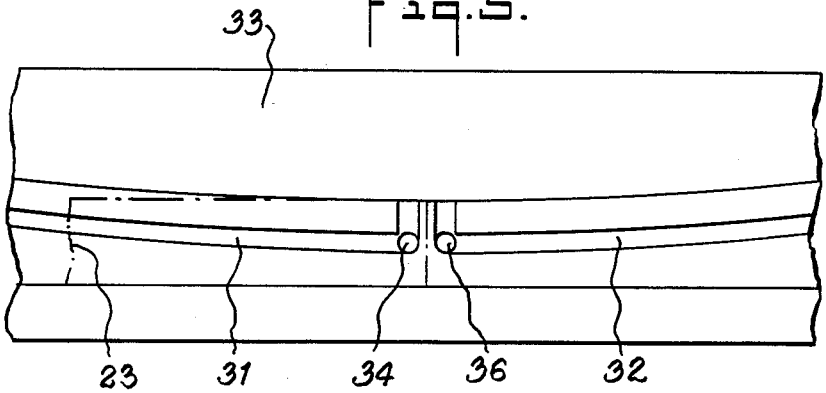
Fig. 6.
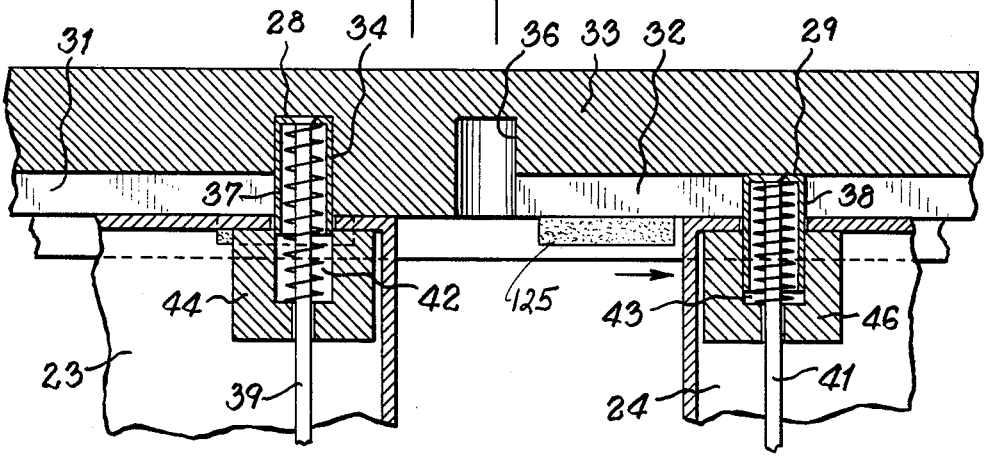
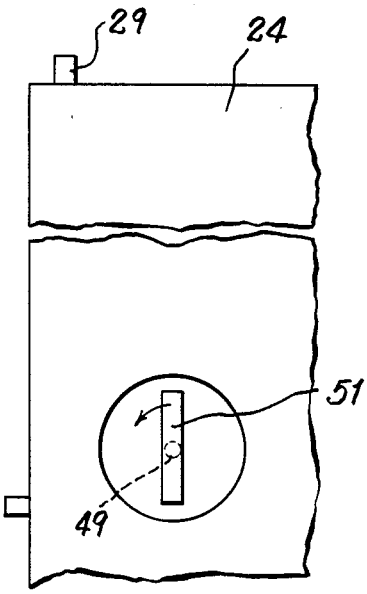
Fig. 7.
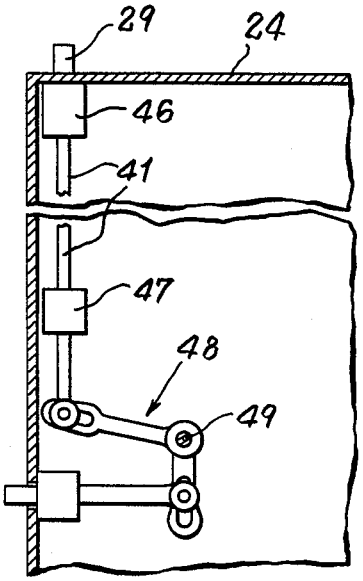
Fig. 8.

Fig. 9.
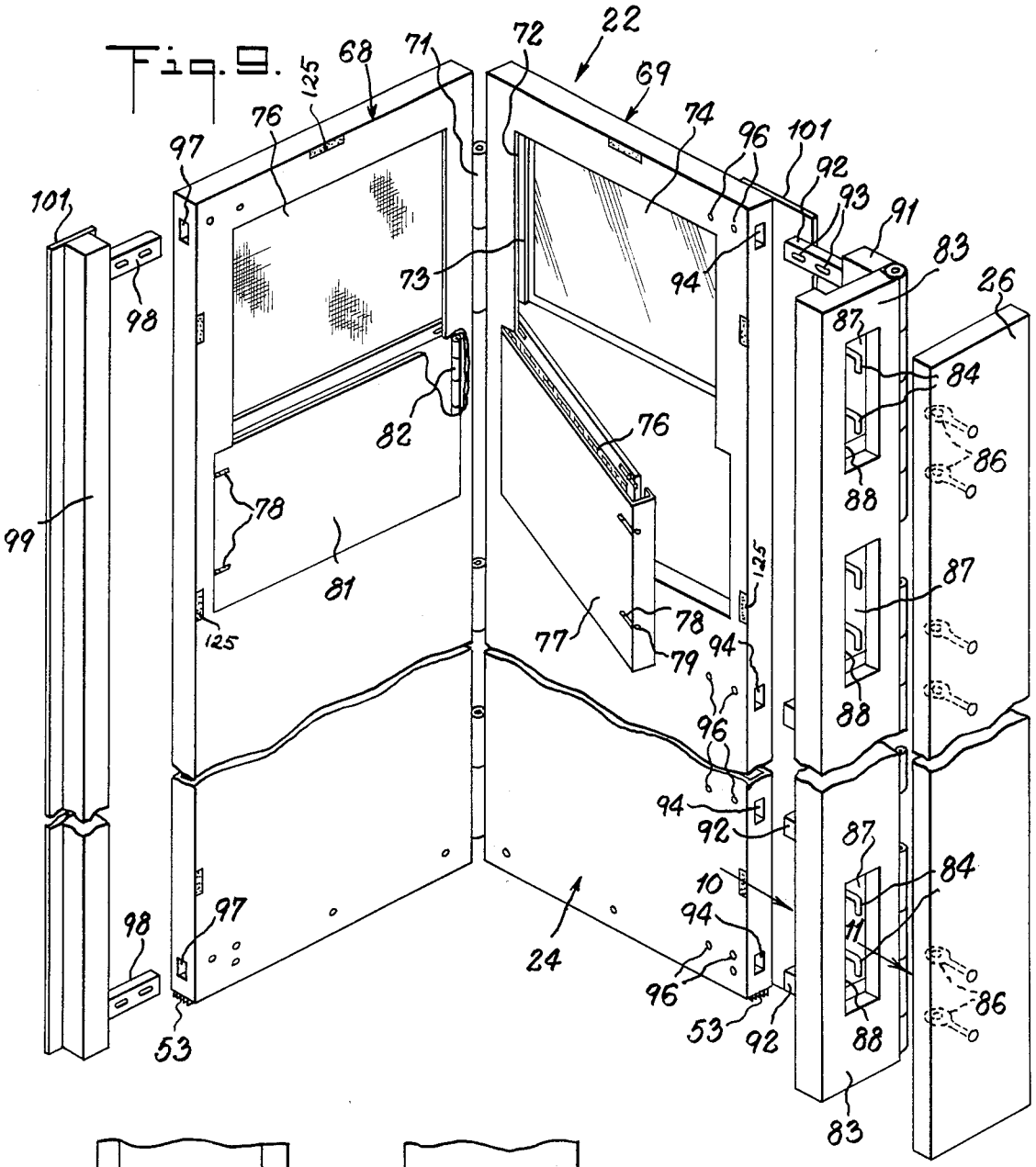
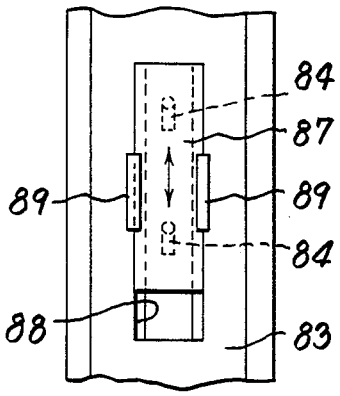
Fig. 10.
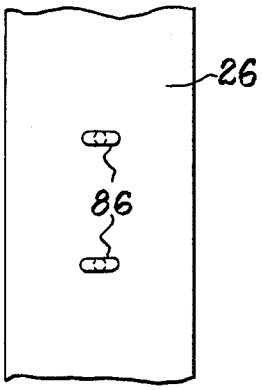
Fig. 11.
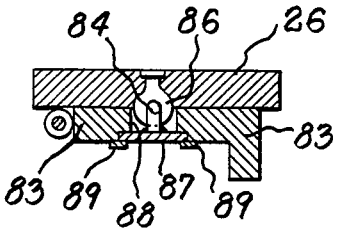
Fig. 12.

24
15
103
111
118
121
117
112
17
113
119
114
17
116
102
124
104
108
106
124
109
107
103
118
117
119
123
122
117
103
119
113
123
121
109
114
121

ADJUSTABLE STORM GARAGE DOOR

BACKGROUND OF THE INVENTION

1. Field of the Invention

The present invention relates to garages having Overhead doors and, more particularly, to an adjustable storm door mounted in spaced relationship with existing Overhead door for providing an insulating air space therebetween.

2. The Prior Art

Applicant is not aware of any prior art relating to garage storm doors.

SUMMARY OF THE INVENTION

Accordingly, an object of the invention is to provide an improved storm garage door as an energy saver in the reduction of heat transfer especially in garages located within buildings.

Another object of the invention is to provide an improved storm garage door for eliminating drafts to reduce the wind chill factor during the winter season.

Still another object of the invention is to provide an improved adjustable garage storm door having screens for providing ventilation during the summer season.

A further object of the invention is to provide a garage storm door having a lock for additional security to that of the Overhead door as a deterrent to break-ins.

A still further object of the invention is to accomplish the foregoing objects in a practical and economical manner.

Other and further objects will be obvious upon an understanding of the illustrative embodiment about to be described, or will be indicated in the appended claims and various advantages not referred to herein will occur to one skilled in the art upon employment of the invention in practice.

In accordance with the present invention the foregoing objects are generally accomplished by providing a folding adjustable garage storm door that is readily disposable exteriorly of an Overhead door to existing jambs of the garage structure. The garage storm door comprises a pair of foldable doors open at the center and removably attached to said jambs of the building. The garage doors are also adjustable in order to compensate for the different opening widths that may be encountered and top jambs are provided with tracks for readily guiding the door during opening and closing thereof.

BRIEF DESCRIPTION OF THE DRAWINGS

Preferred embodiments of the invention have been chosen for purposes of illustration and description and are shown in the accompanying drawings, forming a part of the specification, wherein:

FIG. 1 is a front elevational view of the invention showing the left hand storm door in closed position (Overhead door concealed) and the right hand storm door in open position (Overhead door in full view).

FIG. 2 is a horizontal sectional view of the upper portion of the storm door taken along the line 2—2 of FIG. 1 showing the curved track at the upper jamb area for guiding the storm door during its opening and closing operation.

FIG. 3 is an enlarged sectional view of the bottom portion of the storm door taken along the line 3—3 of FIG. 1 showing the flexible weather strip for compensating for uneveness of the garage floor.

FIG. 4 is an elevational view, partly broken away, taken along the line 4—4 of FIG. 3.

FIG. 5 is an enlarged top plan view of a portion of the upper jamb curved track shown in FIG. 2.

FIG. 6 is an enlarged sectional view taken along the line 6—6 of FIG. 2 showing the spring biased pin meshed in opening of the left storm door for locking the same and the spring biased pin compressed in the right hand storm door and out of mesh with its associated opening during movement of the same.

FIG. 7 is an elevational view of the latch mechanism for the storm door.

FIG. 8 is an elevational view partly in section showing an interior view of the latch mechanism of FIG. 7.

FIG. 9 is a perspective view of the rear side of one of the folding doors, side jamb to which it is removably attached, as well as including window and screen and adjustable side member for compensating for irregularity of storm door.

FIG. 10 is an enlarged elevational view of the hinged member taken along the arrow 10 of FIG. 9.

FIG. 11 is an elevational view of the side jamb showing the mating rings for receiving the movable locking members as taken along the arrow 11 of FIG. 9.

FIG. 12 is a horizontal sectional view showing the elements of FIGS. 10 and 11 in locked position.

DESCRIPTION OF PREFERRED EMBODIMENTS

Figures 13, 14, 15, 16, 17:
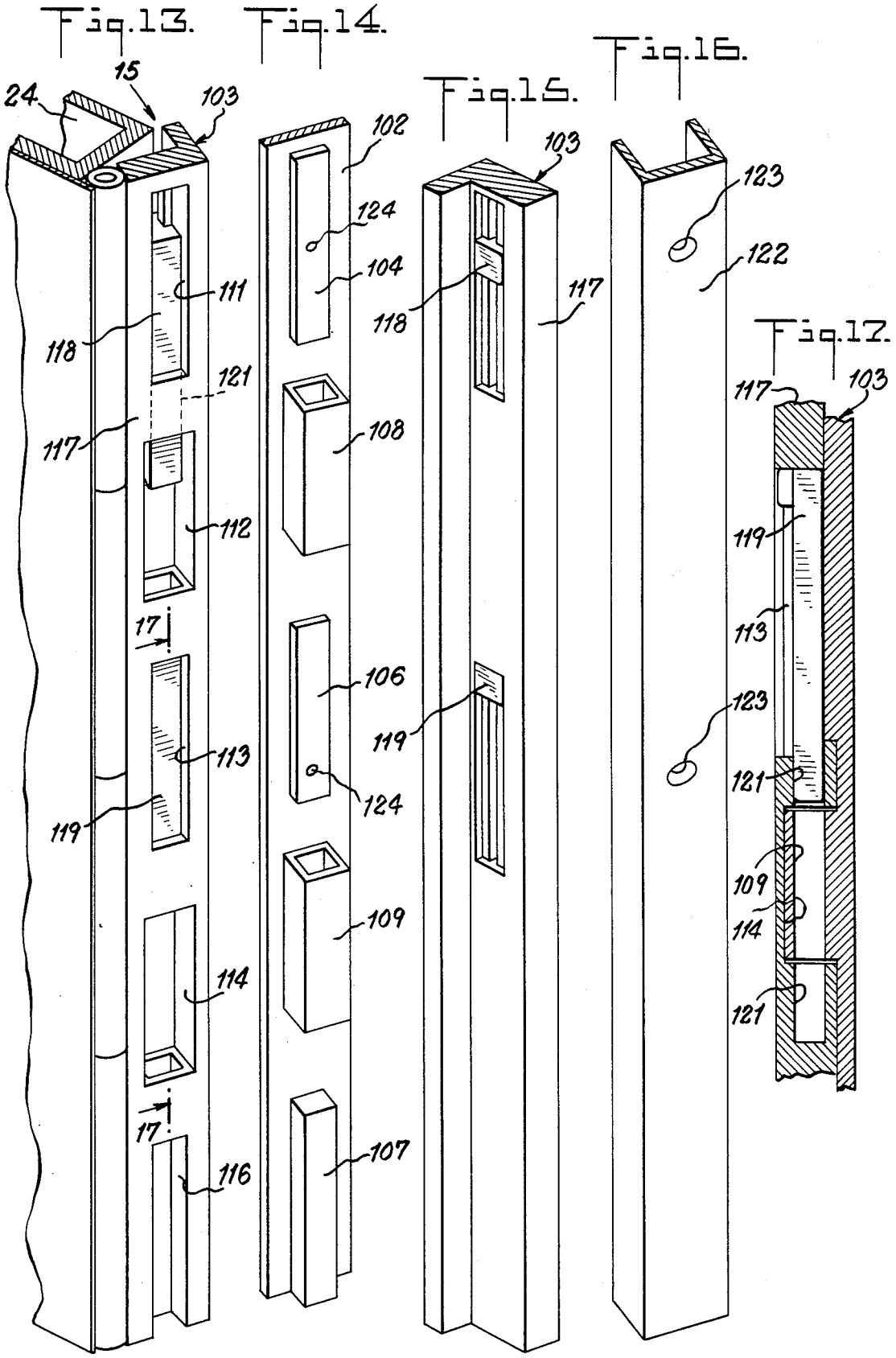
FIG. 13 is a perspective view of another embodiment of door fastening means showing locking elements that cooperate with receiving parts of a fixed jamb.
FIG. 14 is a perspective view of the fixed jamb of FIG. 13 with its receiving elements.
FIG. 15 is a perspective view taken in the direction of the arrow 15 of FIG. 13 showing the slidable locking elements.
FIG. 16 is a perspective view of a cover that is placed over the jamb of FIG. 14 when the storm door is removed.
FIG. 17 is a vertical sectional view of the door and jamb when in unlocked position, just prior to moving locking rod in a downward direction.

Referring now to the drawings, particularly to FIGS. 1–8, there is shown a garage entrance 20 at the lower portion of a dwelling (not shown) having a conventional Overhead door 21 and a garage storm door 22 of the present invention spaced exteriorly of the Overhead door 21 for providing an insulating space therebetween. The storm door 22, as seen in FIGS. 2, 5 and 6, includes two folding doors 23 and 24, which are removably secured, as will be brought out hereinafter, to side jambs 26, attached to corner columns 27 of the dwelling. To provide for ready opening and closing movement each of the folding doors 23, 24 at its upper surface is equipped with a vertically movable spring biased pin 28 and 29 that slides in a track or guideway slot 31 and 32, respectively, in a head jamb 33, as more evident in FIG. 6. The head jamb 33 at the innermost ends of the tracks 31 and 32 has bored openings 34 and 36 for reception of the pins 28 and 29, respectively, when the folding doors 23 and 24 are in closed positions.

In FIG. 6 the folding door 23 is shown in a closed and locked position with the pin 28 biased into the bored opening 34 while the folding door 24 is in movement to the right, as shown by the arrow, with the bored opening 36 unoccupied and the pin 29 depressed in the track 32. To reduce friction while opening and closing the folding doors the pins 28 and 29 comprise casings 37 and 38, respectively, that are freely rotatable at the upper ends of rods 39 and 41, respectively, and which casings are movable in corresponding openings 42 and 43, respectively, of journals 44 and 46, respectively, secured to the folding doors. As viewed in FIGS. 7 and 8, the lower end of the rod 41 passes through a journal 47 to a bell crank locking mechanism 48 pivotally carried by a crank pin 49 and thence to a locking and releasing handle 51 at the exterior of the folding door 24. A similar bell crank locking mechanism is provided for the other folding door 23.

Referring now to FIGS. 3 and 4, there is shown at the bottom of each of the folding doors a flexible rubber seal 52 with five depending elements 53 for increased flexibility in compensating for the irregularity or uneveness of the garage floor 54, as is evident in FIG. 4. The seal 52 is adjustable vertically by attaching it to a base plate 56, in turn secured to a vertical bar 57 that is slidable in a channel 58 formed in a bracket 59 rigidly secured to opposed walls 61,62 of the folding door. The level of the seal 52 and its depending elements 53 is readily adjustable by providing an opening 63 in the wall 62 and a threaded through opening 64 in registry therewith in a wall 66 of the bracket 59. A screw 67 passing through opening 63 and threaded opening 64 and bearing against the vertical bar 57 secures the seal 52 into a fixed position. Several brackets 59 spaced along the bottom of the folding door assures proper flexibility, as is seen in FIG. 4. It is to be noted that conventional seals of single formation, that is, single strips found on storm doors, cannot conform to irregular floor surfaces as with the flexible depending elements 53 of this invention.

Referring now to FIGS. 9–12, the details of the garage storm door 22 and the attachment of the two folding doors 23,24 to the garage structure, as well as between the folding doors themselves, will now be described with the folding door 24 as an example. As seen in FIG. 9, folding door 24 comprises two separate doors 68,69 joined by a hinge 71. The doors 68,69 may be made of any light weight material, preferably of aluminum sheet material 72 formed with an air space 73 therebetween for insulating purposes. Each of the doors 68,69 may include, as shown in FIG. 9, adjustable storm windows 74 and screens 76 of conventional double track construction in the upper two panels thereof. Panel 77 illustrates in detail the inclusion of the storm window 74 and screen 76, as well as conventional latching elements 78,79 for securing the free portion of the panel to the door 69; while panel 81 of door 68 illustrates the placement of a hinge 82 for the swinging panels 77, 81. It is clear that the hinge arrangement of the panels facilitates movement of the storm windows and screens for storing the same.

All garage openings are not obviously of the same dimensional width, so compensation must be made for such width variations. Accordingly, the side jamb 26 (FIG. 2) is rigidly secured in any suitable manner to its corner column 27 of the garage wall structure. A supplemental side jamb 83 (FIG. 9) is removably attached to the side jamb 26 by a hook 84 and eye 86 latch, three such latches being shown. Each set of hooks 84 is mounted on a plate 87 that is vertically movable over an elongate slot 88 and restrained in its path by a guide 89. As indicated in FIG. 10 the hooks 84 are in a raised position, so that when the supplemental jamb 83 is installed onto the jamb 26, the plate 87 is lowered with its hooks 84 into mesh engagement with its eye 86, as seen in FIG. 12.

Referring again to FIG. 9, the supplemental jamb 83 includes a hinged arm 91 and this arm is provided with a number of spaced tenons 92 having spaced openings 93 for insertion into corresponding spaced mortises 94 on the edge of door 69. Depending on the calculated width of the garage opening the tenons 92 when meshed in the mortises 94, are secured by screws (not shown) passing through selected openings 96 in the door and registered openings 93 of the tenons 92. Additional width compensation may be made at the other side of the folding door 24, namely door 68 for spaced mortises 97 that are to be adapted for reception of spaced tenons 98 on an elongate square section 99 of material similar to that of the folding door. A thin sheet 101 of elongate material is added to cover the juncture of the two folding doors when assembled as a garage storm door.

Another embodiment for attaching the garage storm door to the garage structure is shown in FIGS. 13–17. In FIG. 14 is shown a side jamb 102 that is permanently attached to the existing side jamb of the garage and functions as a support for a supplemental side jamb 103 (FIG. 13) that carries the folding door 24. For installation and removal of the storm door both of the jambs 102 and 103 include complementary parts that mesh and unmesh readily. For instance, referring to FIGS. 13, 14, 15 and 17, jamb 102 includes spaced protruding rectangular bars 104,106 and 107 and spaced protruding rectangular tubes 108 and 109 that are adapted to mesh with openings 111,112,113,114 and 116, respectively, in arm 117 of the supplemental side jamb 103. When the jamb 103 is placed on the jamb 102 and the above mesh arrangement occurs, it is a simple matter to latch the two jambs together by moving slugs 118 and 119, FIGS. 13, 15 and 17, of arm 117 downwardly into the tubes 108 and 109, respectively. It is to be noted that arm 117 has a continuous passageway 121 between the openings 111 and 112, etc. for passage of the slugs. In FIG. 13 the slug 118 is shown partially lowered in order to bring it out more clearly. Of course, both slugs 118 and 119 must be in their uppermost positions for proper mesh of the two jambs 102 and 103. To remove the folding door jamb 103 from the jamb 102 it is only necessary to raise the slugs upwardly to unmesh the latch. After the folding garage door is removed, as indicated above, the jamb 102 would remain exposed and perhaps the tubes 108 and 109 damaged. To obviate this and also from an appearance standpoint it is expedient to cover it with a channel member 122 that is secured to the jamb 102 by screws (not shown) passing through clear openings 123 in the channel member 122 and into threaded openings 124 in the bars 104 and 106.

From the foregoing description, it will be seen that the present invention adds to a dwelling a garage storm door that in conjunction with an installed Overhead door provides an insulating air space therebetween. Paradoxically, most dwellings appear to be insulated throughout, except for the garage entrance, which is uninsulated and therefore lets in the cold air. The pair of foldable doors is comparatively light in weight and each is readily opened and closed. To facilitate the closure convention magnets 125, attached to the doors, snap them into a closed position.

As various changes may be made in the form, construction and arrangement of the parts herein without departing from the spirit and scope of the invention and without sacrificing any of its advantages, it is to be understood that all matters are to be interpreted as illustrative and not in any limiting sense.

What is claimed is:

1. A storm garage door comprising in combination, a pair of foldable doors, each of said foldable doors having a free edge portion and an attachable edge portion, means for removably securing said attachable edge portions to walls of a garage entrance, said removably securing means including a side jamb at each wall of said garage entrance, means for securing each of said side jambs to said walls, a supplemental side jamb at each of said walls, means on each of said side jambs and on each of said suplemental side jambs for removably securing each of said suplemental side jambs to each of said side jambs, said supplemental side jambs including spaced slots, plates movable in said slots, hooks mounted on said plates, guiding aligning said plates in said slots during reciprocal, vertical movement, said side jambs including eyes for mesh engagement with said hooks, adjustable means for interconnecting said attachable edge portions and said removably securing means, means for guiding said free edge portions during opening and closing of said foldable doors, a plurality of individual flexible sealing means at a bottom edge of each of said foldable doors, and means for adjusting said flexible sealing means to compensate for an uneven floor of the garage.

2. A storm garage door comprising, in combination, a pair of foldable doors, each of said foldable doors having a free edge portion and an attachable edge portion, means for removably securing said attachable edge portions to walls of a garage entrance, said removably securing means including a side jamb at each wall of said garage entrance, means for securing each of said side jambs to said walls, a supplemental side jamb at each of said walls, means on each of said side jambs and on each of said supplemental side jambs for removably securing each of said supplemental side jambs to each of said side jambs, said supplemental side jambs including spaced openings, slidable slugs in said openings, said side jambs including offset tubes that mesh with said openings to enable the slidable slugs to be moved into said tubes for securement thereof, adjustable means for interconnecting said attachable edge portions and said removably securing means, means for guiding said free edge portions during opening and closing of said foldable doors, a plurality of individual flexible sealing means at a bottom edge of each of said foldable doors, and means for adjusting said flexible sealing means to compensate for an uneven floor of the garage.

3. A storm garage door according to claim 2, wherein each of said supplemental side jambs include an arm, a hinge for securing each of said arms to each of said suplemental side jambs, a plurality of tenons extending from each of said arms, a plurality of mortises opposite said tenons in said attachable edge portions of said foldable doors for mesh engagement with said tensons, and fastening means on said foldable doors for securing said tenons in said mortises at appropriate penetrations.

4. A storm garage door according to claim 3, wherein said guiding means include a head jamb at said garage entrance, an arcuate guideway for each of said foldable doors in said head jamb, a slidable rod for each of said foldable doors adjacent the free edges and at the top thereof, and means for supporting and urging said rods into said guideways, whereby the foldable doors are restrained during opening and closing thereof.

5. A storm garage door according to claim 4, wherein said head jamb has a bored opening at the innermost ends of each of said guideways for penetration of said rods, and locking means for urging said rods into said bored openings when the foldable doors are in a closed position.

6. A storm garage door according to claim 5, wherein said flexible means include a plurality of flexible bodies spaced along bottom edges of said foldable doors, means for supporting said flexible bodies on said foldable doors, a plurality of flexible elements depending from each of said flexible bodies, and means for adjusting the level of each of said spaced bodies to compensate for the uneveness of said garage floor.

* * * * *